US008057266B1

(12) United States Patent
Roitberg

(10) Patent No.: US 8,057,266 B1
(45) Date of Patent: Nov. 15, 2011

(54) POWER CONNECTOR HAVING A CONTACT CONFIGURED TO TRANSMIT ELECTRICAL POWER TO SEPARATE COMPONENTS

(75) Inventor: Lee Jacobo Jose Roitberg, Austin, TX (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/913,587

(22) Filed: Oct. 27, 2010

(51) Int. Cl.
*H01R 13/10* (2006.01)

(52) U.S. Cl. ..... 439/682; 439/907

(58) Field of Classification Search ..... 439/682, 439/907, 507, 510–512
See application file for complete search history.

(56) References Cited

U.S. PATENT DOCUMENTS 3,596,235 A * 7/1971 Teurlings ..... 439/748
4,322,120 A * 3/1982 Rilling ..... 439/631
6,461,172 B2 * 10/2002 Ross ..... 439/78
6,776,635 B2 8/2004 Blanchfield et al.
6,780,027 B2 * 8/2004 Allison ..... 439/79
6,805,591 B2 10/2004 Garland et al.
6,848,950 B2 * 2/2005 Allison et al. ..... 439/682

OTHER PUBLICATIONS 114-13038, Multi-Beam XL* Connectors Jul. 13, 2009 Rev H; 2009 Tyco Electronics Corporation, 15 pgs.
114-13251, Multi-Beam XLE* Connectors Jun. 10, 2009 Rev H, 2009 Tyco Electronics Corporation, 15 pgs.
Faston* Connector, .250 sr. Receptacle Contact (Standard and Piggy-Back versions) & LIF Receptacle contact; 114-20023, * Trademark of AMP Incorporated, FTEC174 rev. 1—Jul. 1999, 3 pgs.

* cited by examiner

*Primary Examiner* — Tho D Ta

(57) ABSTRACT

Power connector including a connector housing having a mating side configured to engage an electrical connector. The connector housing also has a mounting side configured to interface with a circuit board. The connector housing includes a housing cavity that opens to the mating side. The power connector also includes a power contact that is held within the housing cavity. The power contact includes a body panel that extends along a contact plane and has board terminals and a contact terminal that extend from the body panel. The board terminals extend away from the body panel in a mounting direction to engage the circuit board. The contact terminal extends in a different direction that is one of parallel to the circuit board or away from the circuit board. The power contact is configured to transmit electrical power through the board terminals and through the contact terminal.

20 Claims, 4 Drawing Sheets

POWER CONNECTOR HAVING A CONTACT CONFIGURED TO TRANSMIT ELECTRICAL POWER TO SEPARATE COMPONENTS

BACKGROUND OF THE INVENTION

The subject matter herein relates generally to power connectors, and more particularly, to power connectors configured to supply power to separate components in an electrical system.

In some cases, it is desirable to reduce or minimize an amount of space that an electrical system or an electronic device uses. For example, a known computer system may include several electrical components that are enclosed within a common housing. To reduce the amount of spaced used by the computer system, the various electrical components may be arranged and configured with respect to one another to minimize the necessary space while also satisfying predetermined requirements for the computer system.

It may also be desirable to increase the working capabilities of an existing electrical system, such as the computer system discussed above. For instance, during the lifetime of the computer system it may be necessary or desirable to replace an electrical component with a newer version of the electrical component. However, introducing updated electrical components into an existing electrical system may present challenges. For example, if the new electrical component requires additional power to operate, the original configuration of the computer system may not be able to satisfy the increased power demand. One option may be to insert an additional component into the computer system that is capable of providing the power. However, adding an electrical component to an existing computer system may be impractical since the computer system was particularly configured for the other electrical components. It may be necessary to reposition one or more of the other electrical components in order to provide space for the new electrical component.

BRIEF DESCRIPTION OF THE INVENTION

In one embodiment, a power connector is provided that includes a connector housing having a mating side configured to engage an electrical connector. The connector housing also has a mounting side configured to interface with a circuit board. The connector housing includes a housing cavity that opens to the mating side. The power connector also includes a power contact that is held within the housing cavity and configured to engage the electrical connector. The power contact includes a body panel that extends along a contact plane and has board terminals and a contact terminal that extend from the body panel. The board terminals extend away from the body panel in a mounting direction to engage the circuit board. The contact terminal extends in a different direction that is one of parallel to the circuit board or away from the circuit board. The power contact is configured to transmit electrical power through the board terminals and through the contact terminal.

In another embodiment, a power connector is provided that includes a connector housing having a mating side configured to engage an electrical connector and a mounting side configured to interface with a circuit board. The connector housing includes a housing cavity that opens to the mating side. The power connector also has first and second power contacts that are held within the housing cavity and configured to engage the electrical connector. Each of the first and second power contacts includes a body panel that extends along a corresponding contact plane. Each of the first and second power contacts has board terminals that extend away from the respective body panel in a mounting direction to engage the circuit board. The first power contact includes a contact terminal extending away from the body panel of the first power contact in a direction that is different than the mounting direction. The first power contact is configured to transmit electrical power through the contact terminal and through the respective board terminals. The second power contact is configured to exclusively transmit electrical power between the electrical connector and the circuit board.

DETAILED DESCRIPTION OF THE INVENTION

Embodiments described herein include power connectors that are configured to be mounted to a first electrical component, such as a circuit board. The power connectors include one or more power contacts that are capable of providing separate electrical pathways to deliver power to the first electrical component and to a separate second electrical component. For example, the power contacts may include board terminals that electrically engage a circuit board and a contact terminal that extends in a direction that is one of parallel to the circuit board or away from the circuit board. The contact terminal may engage the second electrical component (e.g., video card). In particular embodiments, power connectors may include first and second types of power contacts. The first type of power contacts include the contact terminals and are capable of delivering power to separate components, and the second type of power contacts may not include the contact terminals and may exclusively transmit electrical power to one electrical component (e.g., a circuit board). The first and second types of power contacts may have similar structures so that the first and second types of power contacts can be inserted into similarly shaped contact-receiving slots. Moreover, in some embodiments, the first type of power contacts may be used to replace the second type of power contacts (also referred to as existing power contacts).

Figure 1:
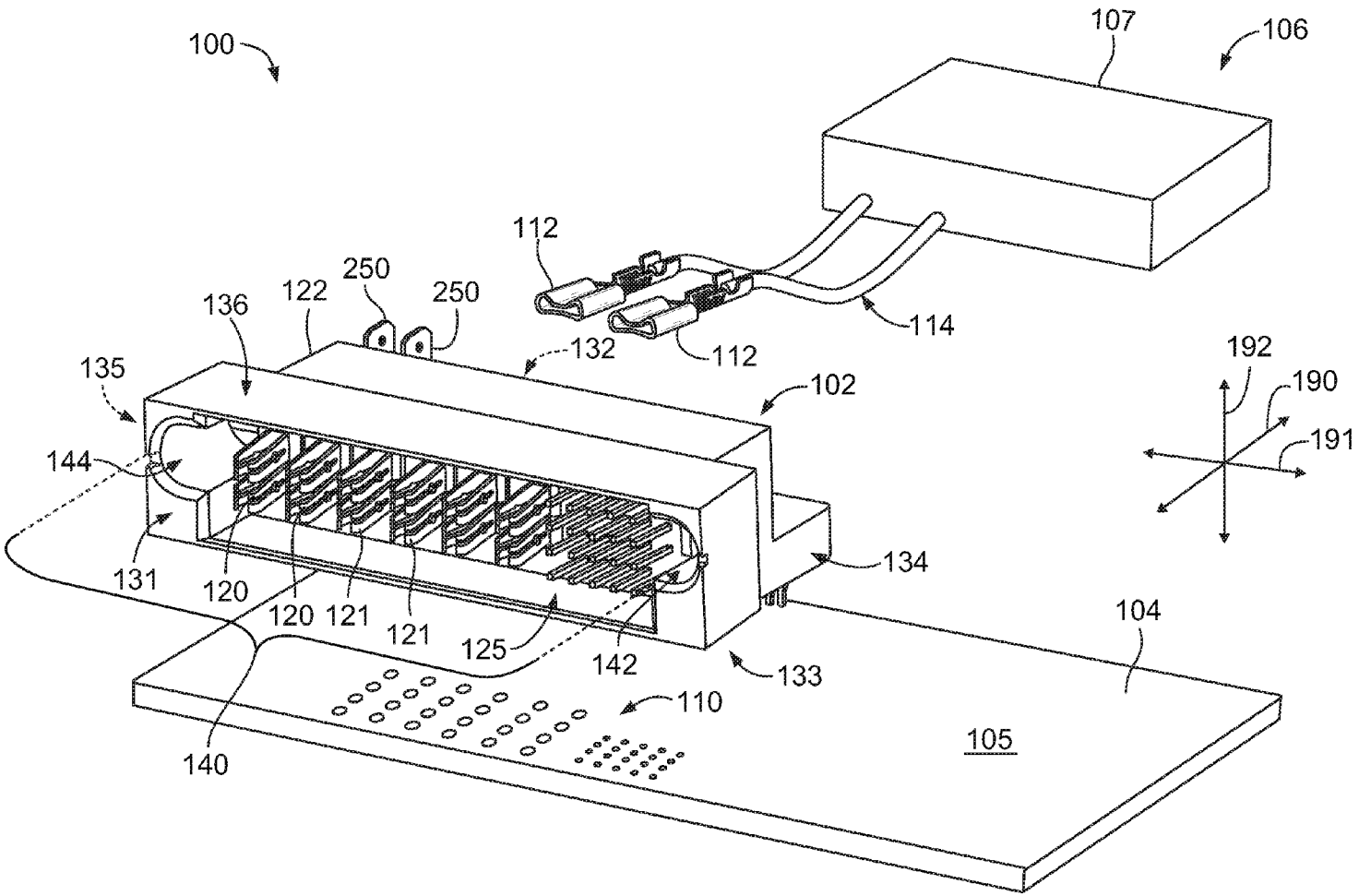
FIG. 1 is an exploded view of an electrical assembly that includes a power connector formed in accordance with one embodiment.

FIG. 1 is an exploded view of an electrical assembly 100 that includes a power connector 102 formed in accordance with one embodiment. The electrical assembly 100 also includes a circuit board 104 and an electrical component 106. Both the circuit board 104 and the electrical component 106 may receive electrical power from the power connector 102. The electrical assembly 100 may be located within, for example, a housing of a larger electrical system (not shown). The power connector 102 is configured to transmit electrical power that is delivered from a mating or electrical connector (not shown) to the circuit board 104 and also to the electrical component 106. The electrical connector may be similar to the electrical connector 305 shown in FIG. 7. The power connector 102 and the electrical connector may also be referred to as first and second connectors, respectively. Furthermore, the circuit board 104 and the electrical component 106 may be referred to as first and second electrical components, respectively. As shown in FIG. 1, the electrical component 106 may be located remotely from the power connector 102.

In particular embodiments, the power connector 102 is configured to be mounted and electrically engaged to the circuit board 104. The power connector 102 includes power contacts 120 that electrically engage thru-holes 110 of the circuit board 104 and also electrically engage corresponding component contacts 112 of the electrical component 106. The power connector 102 may also include power contacts 121 that engage only the electrical connector and the circuit board 104. In addition to the power contacts 120 and 121, the power connector 102 may include signal contacts 125 that transmit signals between the electrical connector and the circuit board 104.

An electrical component may be, for example, an electrical device of the larger electrical system (e.g., video card, housing fan, network card, and the like), another circuit board, or another electrical connector. In the illustrated embodiment, the electrical component 106 includes the component contacts 112 and wires 114. The component contacts 112 may be Faston® contacts produced by Tyco Electronics that are configured to grip contact terminals 250 of the power contacts 120. The component contacts 112 may be coupled to the wires 114 through crimping. The wires 114, in turn, may be electrically coupled to a component body 107 of the electrical component 106. In alternative embodiments, the component contacts 112 may be of other types, such as pin contacts, socket contacts, contact pads, and the like. Furthermore, the component contacts 112 may be directly connected to the electrical component 106 (i.e., without the interconnecting wires 114). In such embodiments, the electrical component 106 may be directly mounted to the power connector 102.

Figure 7:
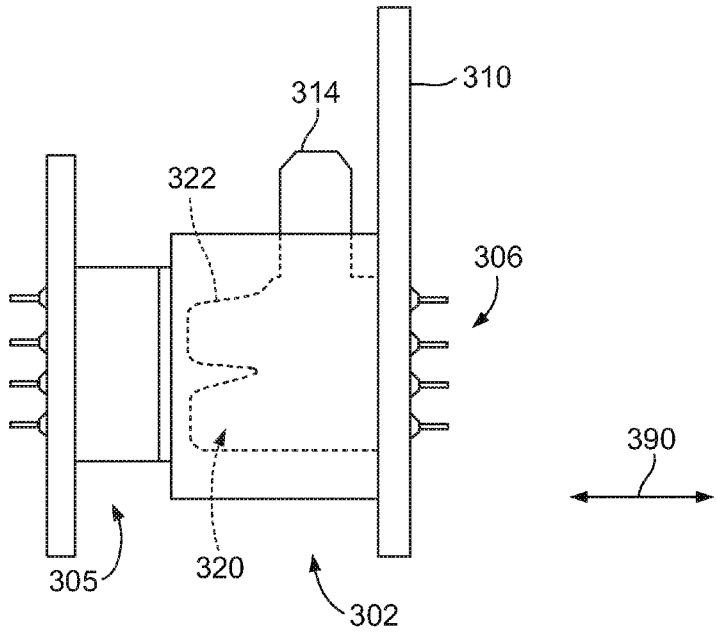
FIG. 7 is a side view of a power connector formed in accordance with another embodiment that is engaged with an electrical connector.

The power connector 102 includes a connector housing 122 having a plurality of housing sides 131-136. As shown, the power connector 102 is oriented with respect to a longitudinal axis 190, a lateral axis 191, and an orientation axis 192. The housing sides 131-136 may include a mating side 131, a loading side 132, and a mounting side 133 that extends between the mating and loading sides 131 and 132 in a direction along the longitudinal axis 190. In the illustrated embodiment, the power connector 102 is a right-angle connector such that the mating and loading sides 131 and 132 are opposite of each other (i.e., the mating and loading sides 131 and 132 face in opposite directions away from each other). However, in alternative embodiments, the power connector 102 may be a vertical or straight connector such that the mating and mounting sides 131 and 133 are opposite with respect to each other and the loading side 132 extends therebetween. The power connector 302 shown in FIG. 7 illustrates such an embodiment.

The housing sides 131-136 also include end sides 134 and 135 that extend between the mating and loading sides 131 and 132 in a direction along the longitudinal axis 190. The end sides 134 and 135 also have the lateral axis 191 extending therebetween. Furthermore, the connector housing 122 may include the housing side 136 that is opposite with respect to the mounting side 133. As shown, the mounting side 133 is configured to be mounted to and interface with a board surface 105 of the circuit board 104.

Also shown in FIG. 1, the connector housing 122 includes a housing cavity 140 that opens to the mating side 131. The mating side 131 is configured to engage the electrical connector (not shown). The connector housing 122 is configured to hold one or more of the power contacts 120 and 121 and the signal contacts in the housing cavity 140. The housing cavity 140 is sized and shaped to receive the electrical connector. The electrical connector includes corresponding mating contacts (not shown) that electrically engage the power contacts 120 and 121 and the signal contacts 125. The housing cavity 140 may also include alignment spaces 142 and 144. The alignment spaces 142 and 144 are configured to receive alignment features (not shown) of the electrical connector to align the electrical connector and the power connector 102.

By way of example only, the electrical connector and the power connector 102 may be board-to-board connectors that establish an electrical connection through each other to transmit power and data signals between separate circuit boards. The circuit boards may be oriented to be co-planar with each other, parallel to each other, or perpendicular to each other when the electrical connector and the power connector 102 are engaged. However, the electrical connector and the power connector 102 may be configured to establish an electrical connection between other components and at other orientations. In particular embodiments, the electrical connector is a plug assembly and the power connector 102 is a right-angle receptacle assembly. Alternatively, the electrical connector may be the receptacle assembly and the power connector 102 may be the plug assembly.

Figure 2:
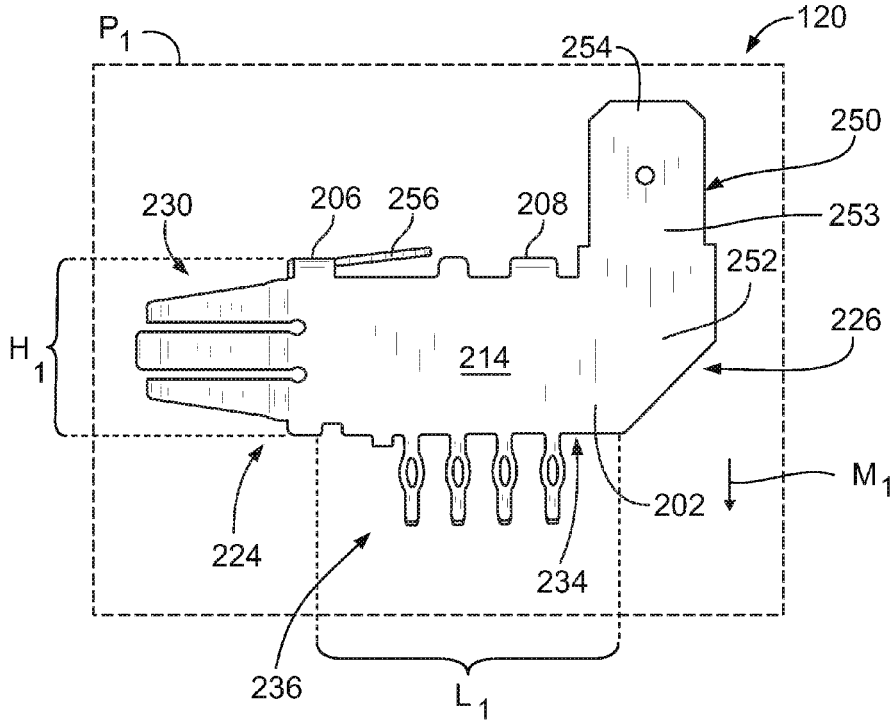
FIG. 2 is a side view of a power contact that may be used with the power connector of FIG. 1.
Figure 3:
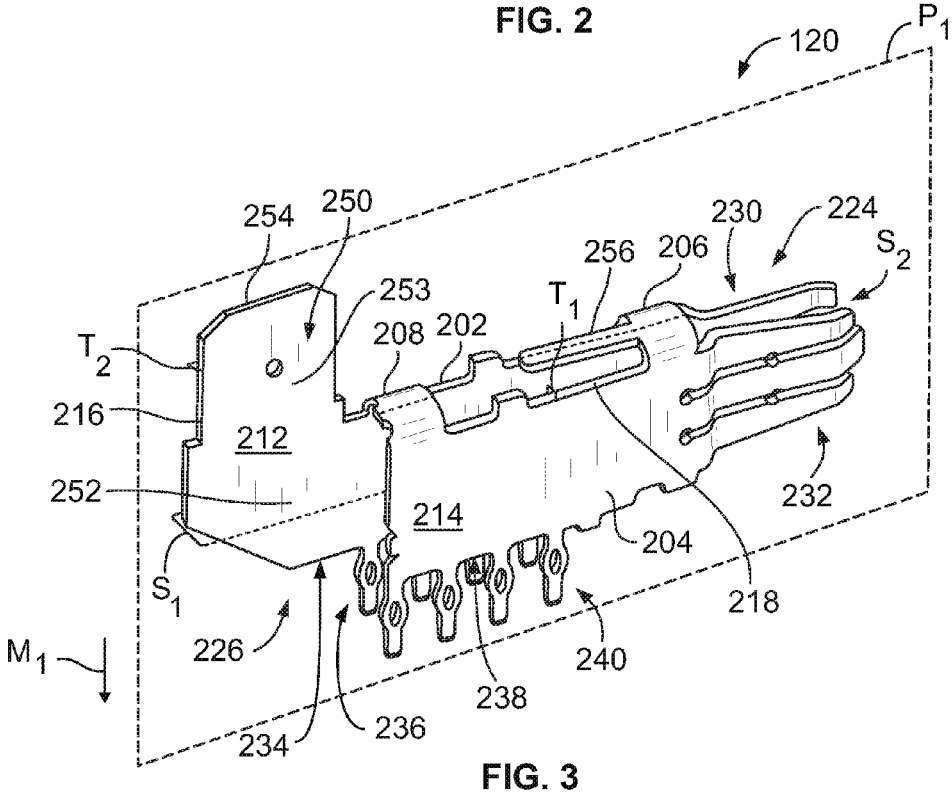
FIG. 3 is a perspective view of the power contact of FIG. 2.

FIGS. 2 and 3 are isolated side and perspective views, respectively, of the power contact 120. In the illustrated embodiment, the power contact 120 includes first and second body panels 202 and 204 (FIG. 3) and bridge portions 206 and 208 that join the body panels 202 and 204. The body panels 202 and 204 may be substantially planar structures and extend parallel to each other with a spacing $S_1$ (FIG. 3) therebetween. As shown, the power contact 120 may be oriented with respect to a contact plane $P_1$ that extends substantially parallel to the body panels 202 and 204 within the spacing $S_1$. The contact plane $P_1$ intersects the bridge portions 206 and 208 along the dashed lines, as shown in FIG. 3, and the body panels 202 and 204 are on opposite sides of the contact plane $P_1$.

With reference to FIG. 3, the power contact 120 may be stamped and formed from a conductive sheet of material in some embodiments. As shown, the sheet of material may be stamped along stamped edges 216 and 218. The stamped sheet of material may have opposite side surfaces 212 and 214 that define a thickness $T_1$ therebetween. In the illustrated embodiment, the thickness $T_1$ is uniform throughout the power contact 120. The stamped sheet of material may be folded at the bridge portions 206 and 208 such that the body panels 202 and 204 overlap and are parallel to each other. Also shown in FIG. 3, the side surface 212 along the body panel 202 faces the side surface 212 along the body panel 204. The body panels 202 and 204 may face each other across the spacing $S_1$.

As shown in FIGS. 2 and 3, the power contact 120 may have a leading end 224 and a trailing end 226. The body panel 202 includes one or more contact beams 230 that project in a longitudinal direction (i.e., in a direction along the longitudinal axis 190 (FIG. 1)) from the leading end 224. The body panel 204 includes one or more contact beams 232 (FIG. 3) that project in a longitudinal direction from the leading end 224. The contact beams 230 and 232 extend generally parallel to one another. The contact beams 230 and 232 are opposite each other and have a spacing $S_2$ (FIG. 3) therebetween. The contact beams 230 and 232 may be shaped to engage a corresponding contact (not shown) of the electrical connector. For example, the contact beams 230 and 232 may engage the corresponding contact along the side surface 214 such that the contact beams 230 and 232 are deflected toward one another. However, in alternative embodiments, the contact beams 230 and 232 may have other configurations and be configured to engage the corresponding contact in other manners. For example, the corresponding contact may be received within the spacing $S_2$ between the contact beams 230 and 232 such that the contact beams 230 and 232 flex away from each other.

The body panel 202 also includes a mounting edge 234 that extends between the leading and trailing ends 224 and 226. The power contact 120 may include a plurality of board terminals 236 that project therefrom in a mounting direction $M_1$. The mounting direction $M_1$ may be in a direction along the orientation axis 192 (FIG. 1). Likewise, the body panel 204 also includes a mounting edge 238 (FIG. 3) that extends between the leading and trailing ends 224 and 226 of the power contact 120. The power contact 120 may include a plurality of board terminals 240 (FIG. 3) that project therefrom in the mounting direction $M_1$. The board terminals 236 and 240 may extend substantially parallel to one another.

Also shown in FIGS. 2 and 3, the body panel 202 may include a contact terminal 250 that projects from the trailing end 226. The contact terminal 250 and the board terminals 236 and 240 extend in different directions. In particular embodiments, the contact terminal 250 extends in a direction that is away from the circuit board 104 (FIG. 1). For example, as shown, the contact terminal 250 may extend in a direction that is generally opposite with respect to the mounting direction $M_1$. Furthermore, in alternative embodiments, the contact terminal 250 may extend in a direction that is oblique with respect to the board surface 105 (FIG. 1). In other embodiments, the contact terminal 250 may extend in a direction that is substantially parallel to the circuit board 104. By extending in a direction that is one of away from the circuit board 104 or parallel to the circuit board 104, the contact terminal 250 may be spaced apart from the circuit board 104 so that a corresponding component contact 112 (FIG. 1) and the contact terminal 250 may engage each other.

The contact terminal 250 has a base portion 252 that extends from the trailing end 226 and a distal end 254 that is configured to be received by the component contacts 112. A terminal body 253 may extend between the base portion 252 and the distal end 254. In the illustrated embodiment, the contact terminal 250 is a contact blade or contact tab. The distal end 254 may be shaped to engage a Faston®-type contact. Moreover, the contact terminal 250 may have a substantially planar structure that has a thickness $T_2$ (FIG. 3). The thickness $T_2$ may be substantially equal to the thickness $T_1$.

In some embodiments, the body panel 202 and the board terminals 236 are coplanar. In some embodiments, the board terminals 236 and the contact terminal 250 are coplanar. In the illustrated embodiment, the contact terminal 250 is coplanar with the board terminals 236 and also the body panel 202. More specifically, the body panel 202, the contact terminal 250, and the board terminals 236 may be coplanar and extend parallel to the contact plane $P_1$. The body panel 202, the contact terminal 250, and the board terminals 236 may also have a uniform thickness $T_1$.

Also shown in FIGS. 2 and 3, the power contact 120 may include a spring member 256. The spring member 256 may extend from the bridge portion 206 in a rearward direction toward the trailing end 226. However, in alternative embodiments, the spring member 256 may have a different position. As shown, the spring member 256 is in a relaxed position, but the spring member 256 is also configured to be deflected toward the body panels 202 and 204.

With reference to FIG. 2, the body panel 202 may have a panel structure that is sized and shaped to accommodate the board terminals 236 and the contact beams 230 extending therefrom. For example, the mounting edge 234 along the body panel 202 may extend a length $L_1$ (or a first dimension) between the leading and trailing ends 224 and 226 that is long enough to accommodate the plurality of board terminals 236. The board terminals 236 may be spaced apart from each other in the longitudinal direction along the mounting edge 234. Furthermore, the board terminals 236 may be aligned with one another along the mounting edge 234. In the illustrated embodiment, the length $L_1$ is sufficiently long to accommodate four (4) board terminals 236 that are aligned and spaced apart from each other along the mounting edge 234. In alternative embodiments, the length $L_1$ may be configured to accommodate only a single board terminal, at least two, at least three, or more than four board terminals 236. In addition, the power contact 120 may have a height $H_1$ (or a second dimension) that is able to accommodate the plurality of contact beams 230. As shown, the power contact 120 may have three (3) contact beams 230 projecting from the leading end 224 that are stacked or aligned with respect to each other along the orientation axis 192 (FIG. 1). However, in alternative embodiments, the power contact 120 may have only a single contact beam, two contact beams, or more than three contact beams.

Although not shown in FIG. 2, the board terminals 240, the contact beams 232, and the body panel 204 (FIG. 3) may also be configured similarly as described above with respect to the board terminals 236 and the contact beams 230 of the body panel 202.

Although the illustrated embodiment of the power contact 120 includes a pair of body panels 202 and 204, in alternative embodiments, the power contact 120 may only include a single body panel. For example, the power contact 120 may only include a body panel without the bridge portions 206 and 208 and the body panel 204. In such embodiments, the body panel may have similar elements and features as described above with respect to the body panel 202. Electrical power may be transmitted through a contact terminal, such as the contact terminal 250, and a plurality of board terminals, such as the board terminals 236.

Figure 4:
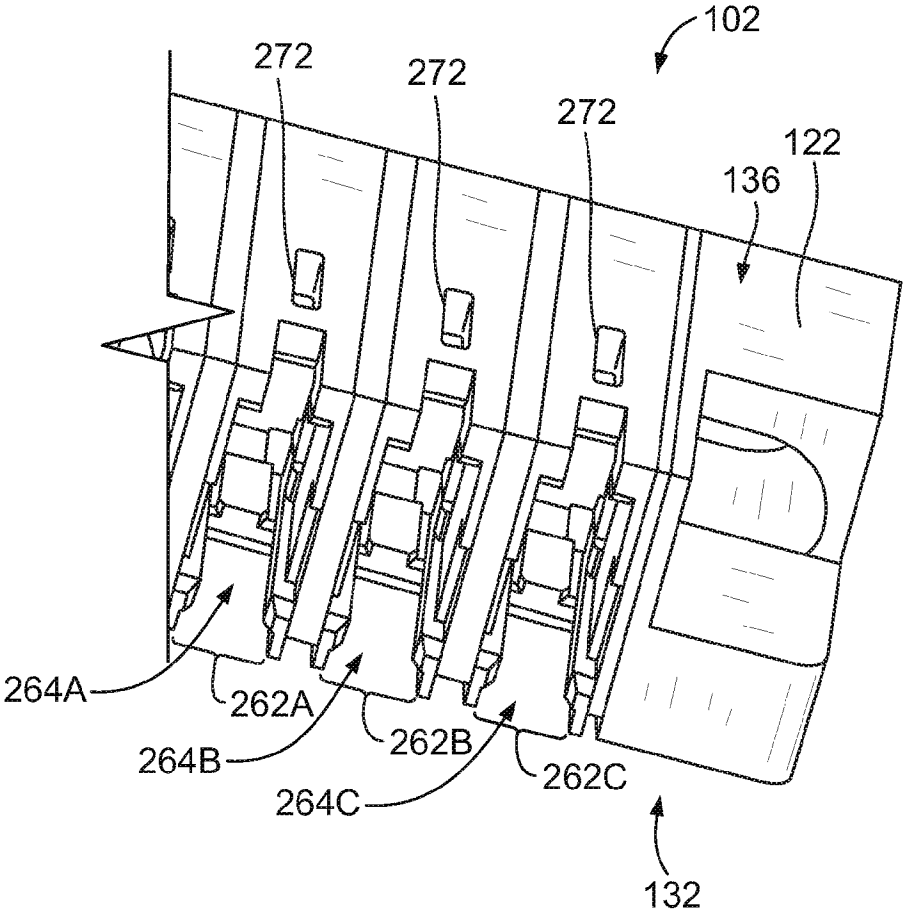
FIG. 4 is a perspective view of a portion of a connector housing that may be used with the power connector of FIG. 1.

FIG. 4 is a perspective view of a portion of the loading side 132 of the power connector 102. As shown, the connector housing 122 may include a plurality of access openings 262A-262C that provide access to respective contact-receiving slots 264A-264C. The contact-receiving slots 264A-264C may be defined by portions of the housing cavity 140 (FIG. 1) where corresponding power contacts 120 and 121 (FIG. 1) are held by the connector housing 122. The connector housing 122 may comprise an insulative material that is molded into single structure. Alternatively, the connector housing 122 may be constructed from separate parts into an integral structure. Also shown in FIG. 4, the connector housing 122 may include a plurality of member holes 272. Each of the member holes 272 extends through the connector housing 122 from a corresponding contact-receiving slot 264 to an exterior of the connector housing 122. The member holes 272 extend through the housing side 136.

Figure 5:
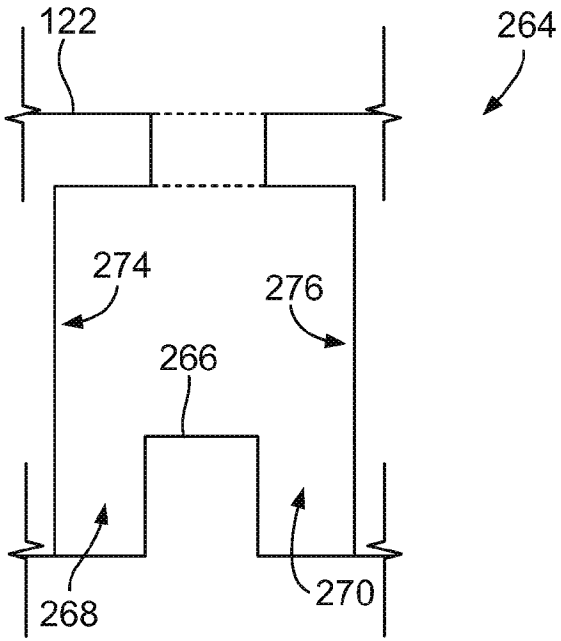
FIG. 5 is an end-view of a contact-receiving slot that may be used with the electrical connector of FIG. 1.

FIG. 5 is an end-view of an exemplary contact-receiving slot 264. The connector housing 122 may be shaped to include opposing sidewalls 274 and 276 that define at least a portion of the corresponding contact-receiving slots 264. The connector housing 122 may also include a base support 266 and a pair of guide channels 268 and 270 that extend between the sidewalls 274 and 276 and the base support 266. The guide channels 268 and 270 are sized and shaped to receive the body panels 202 and 204 (FIGS. 2 and 3) such that the mounting edges 234 and 238 (FIGS. 2 and 3) rest along surfaces of the guide channels 268 and 270, respectively.

The contact-receiving slots 264A-264C may be similarly or identically shaped. Furthermore, the power contacts 120 and 121 may have similar structures such that identically or similarly shaped contact-receiving slots 264 may hold either of the power contacts 120 and 121. Accordingly, the power connector 102 (FIG. 1) may be reconfigured as desired. Furthermore, existing power contacts that are similar to power contacts 121 may be replaced by the power contacts 120. Also, although not shown, the power contacts 120 and 121 may have an identical number and arrangement of board terminals, such as the board terminals 236 and 240.

Figure 6:
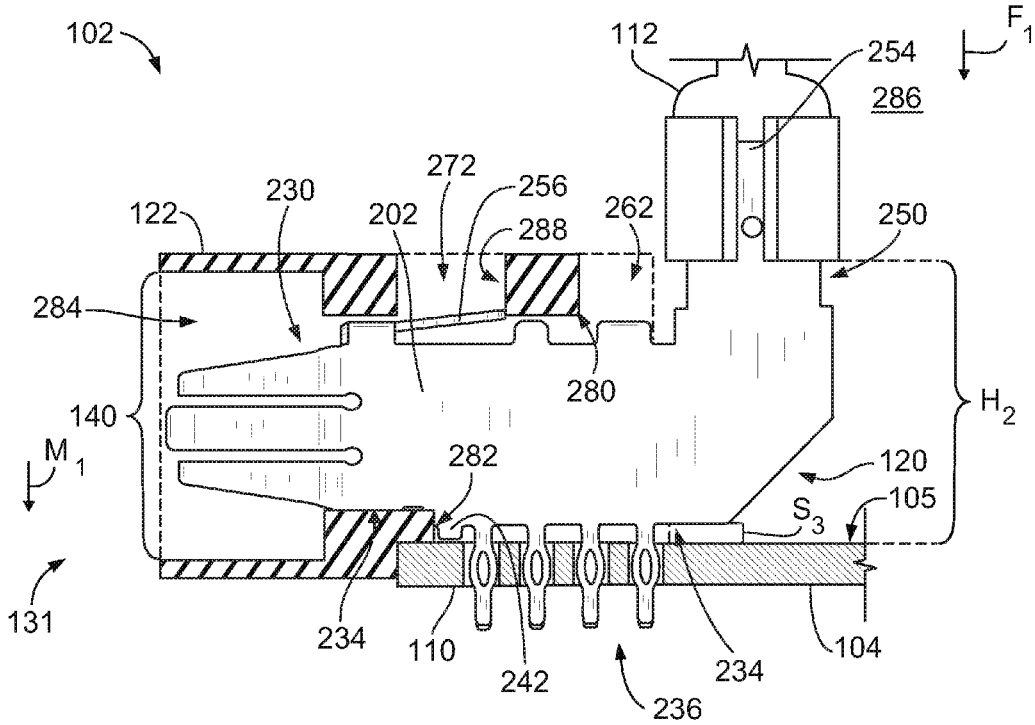
FIG. 6 is a cross-section of the power connector of FIG. 1.

FIG. 6 is a cross-section of the power connector 102 illustrating one of the power contacts 120 in the housing cavity 140. To assemble the power connector 102, the power contact 120 may be positioned and aligned to face the corresponding access opening 262. The power contact 120 may be moved toward the access opening 262 so that the contact beams 230 and 232 (FIG. 3) first advance through the access opening 262 and into a corresponding contact-receiving slot 264 (FIG. 5) of the housing cavity 140. The mounting edges 234 and 238 (FIG. 3) may be inserted into and slide along the guide channels 268 and 270, respectively (FIG. 5). As shown, the power contact 120 may include one or more positioning members 242 that project in the mounting direction $M_1$ away from the mounting edges 234 and 238. The positioning members 242 may engage an interior surface 282 of the connector housing 122. The positioning member 242 and the interior surface 282 may prevent the power contact 120 from advancing further into the contact-receiving slot 264.

As the power contact 120 is inserted into the contact-receiving slot 264, the spring member 256 may engage an interior edge 280 of the connector housing 122. The spring member 256 may be deflected from a relaxed condition toward the body panels 202 and 204 (FIG. 3) and flex back to the relaxed condition when the spring member 256 is located within the member hole 272. When the spring member 256 is located within the member hole 272, the spring member 256 may engage the connector housing 122 at an interior surface 288 to prevent the power contact 120 from being withdrawn from the contact-receiving slot 264. To remove the power contact 120, the spring member 256 may be deflected toward the body panels 202 and 204 and the power contact 120 may be withdrawn.

As shown in FIG. 6, when the positioning member 242 and the spring member 256 engage the connector housing 122, the positioning and spring members 242 and 256 may cooperate with each other to prevent the power contact 120 from being moved in a direction along the longitudinal axis 190 (FIG. 1). The sidewalls 274 and 276 (FIG. 5) may also prevent the power contact 120 from being shifted in a direction along the lateral axis 191 or rotated about the orientation axis 192 (FIG. 1). Accordingly, the contact-receiving slot 264 may be configured to retain the power contact 120 therein.

When the power contact 120 is disposed within the housing cavity 140, the contact beams 230 and 232 may be located within an engagement space 284 of the housing cavity 140 proximate to the mating side 131. The engagement space 284 may be sized and shaped to receive a portion of the electrical connector. Also shown, the contact terminal 250 extends into an exterior space 286 that surrounds at least a portion of the connector housing 122. For example, the distal end 254 may extend beyond a height $H_2$ of the connector housing 122 such that the distal end 254 is exposed and positioned to engage the corresponding component contact 112 of the electrical component 106 (FIG. 1).

Also shown in FIG. 6, the board terminals 236 and 240 (FIG. 3) are sized and shaped to engage and form an interference fit with the thru-holes 110 of the circuit board 104 when the power connector 102 is mounted to the circuit board 104. When the power connector 102 is mounted to the circuit board 104, the mounting edges 234 and 238 may interface with the board surface 105. As shown, a spacing $S_3$ may exist between the mounting edges 234 and 238 and the board surface 105. The board terminals 236 and 240 may be sized and shaped to transmit electrical power to the circuit board 104. In the illustrated embodiment, the board terminals 236 and 240 are eye-of-needle contacts, but the board terminals 236 and 240 may be other contacts (e.g., pin contacts).

Accordingly, the power contact 120 may receive electrical power through the contact beams 230 and 232 and transmit the electrical power through several pathways. In the illustrated embodiment, the electrical power may be diverted along nine (9) separate pathways (eight board terminals 236 and 240 and the contact terminal 250). Moreover, the electrical power may be transmitted to separate components, such as the circuit board 104 and the electrical component 106 (FIG. 1). Accordingly, the body panels 202 and 204 may be sized and shaped to transmit a large amount of electrical current as compared to other contacts. By way of one example only, the power contact 120 may be configured to transmit about 45 A at a 30° C. temperature rise, and the contact terminal 250 may be configured to transmit 25 A.

Also shown in FIG. 6, the component contact 112 may grip the contact terminal 250. To engage the component contact 112 and the contact terminal 250, a contact force $F_1$ may be applied to form an interference or compressive fit between the component contact 112 and the contact terminal 250. The contact force $F_1$ may be applied in a direction that is generally opposite to the direction that the contact terminal 250 extends from the body panel 202. For example, in the illustrated embodiment, the contact force $F_1$ is applied in a direction along the mounting direction $M_1$. In some embodiments, the contact terminal 250 may have dimensions that prevent inadvertent bending or deformation of the contact terminal 250 about the longitudinal or lateral axes 190 and 191 when the contact force $F_1$ is applied. For example, the contact terminal 250 may be sized and shaped to resist deformation when the component contact 112 is engaged to the contact terminal 250 in a misaligned manner.

FIG. 7 is a side view of a power connector 302 formed in accordance with another embodiment that is engaged with an electrical connector 305. The electrical connector 305 may be a plug assembly and the power connector 302 may be a receptacle assembly configured to receive the electrical connector 305. The power connector 302 is mounted to a circuit board 310 and includes a power contact 322. In some embodiments, the power connector 302 is a vertical or axial connector. More specifically, the power connector 302 may have a vertical orientation such that contact beams 320 (indicated by dashed lines in FIG. 7) and board terminals 306 of the power contact 322 extend in a common direction along a longitudinal axis 390. Also shown, the power contact 322 may include a contact terminal 314 that is similar to the contact terminal 250 (FIG. 2). The contact terminal 314 in FIG. 7 extends in a direction that is parallel to the circuit board 310 and perpendicular to the longitudinal axis 390.

In some embodiments, a method of assembling a power connector, such as the power connectors 102 and 302, is provided. The method may include providing a connector housing that has a mating side that is configured to engage an electrical connector and a mounting side that is configured to interface with a circuit board. The connector housing includes a housing cavity that opens to the mating side. The method may also include disposing or positioning a power contact within the housing cavity. The power contact includes a body panel that extends along a contact plane and has board terminals and a contact terminal extending therefrom. The board terminals extend away from the body panel in a mounting direction to engage the circuit board. The contact terminal extends one of parallel to the circuit board or away from the circuit board. The power contact is configured to transmit electrical power through the board terminals and through the contact terminal.

In some embodiments, the method includes removing an existing power contact from a contact-receiving slot of the connector housing before disposing the power contact having the contact terminal within the housing cavity. An existing power contact is a power contact that has already been in commercial use. The existing power contact may not include a contact terminal, such as the power contacts 121 described above. In other embodiments, the method may include disposing a second power contact into the housing cavity. The second power contact may exclusively transmit electrical power to the circuit board, such as the power contacts 121. More specifically, the second power contact may not include a contact terminal in some embodiments.

It is to be understood that the above description is intended to be illustrative, and not restrictive. In addition, the above-described embodiments (and/or aspects or features thereof) may be used in combination with each other. Furthermore, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A power connector comprising:

a connector housing having a mating side configured to engage an electrical connector and a loading side that is opposite the mating side and has an access opening, the connector housing also having a mounting side that is configured to interface with a circuit board and a housing side that is opposite the mounting side, the connector housing including a housing cavity; and a power contact held within the housing cavity and configured to engage the electrical connector, the power contact comprising first and second body panels and a bridge portion that joins the first and second body panels, the power contact being folded at the bridge portion such that the first and second body panels extend adjacent to each other, the first and second body panels having board terminals that extend away from the respective body panel in a mounting direction to engage the circuit board, the first body panel also having a contact terminal that is configured to engage a component contact;

wherein the contact terminal extends through the access opening of the loading side, the contact terminal including a base portion that extends beyond the loading side in a direction along the circuit board and also a terminal body that extends from the base portion in a direction that is away from the circuit board, the terminal body configured to engage the component contact when the component contact is moved in the mounting direction toward the circuit board.

2. The power connector in accordance with claim 1, wherein the first body panel and the respective board terminals are coplanar and the second body panel and the respective board terminals are coplanar.

3. The power connector in accordance with claim 1, wherein the first body panel and the contact terminal are coplanar.

4. The power connector in accordance with claim 1, wherein the contact terminal is sized and shaped to resist deformation when the component contact is engaged to the in a misaligned manner.

5. The power connector in accordance with claim 1, wherein the mounting and mating sides are oriented perpendicular to each other.

6. The power connector in accordance with claim 1, wherein the second body panel does not have a contact terminal extending therefrom.

7. The power connector in accordance with claim 1, wherein the access opening is sized and shaped to permit the power contact to be loaded into the housing cavity through the loading side.

8. The power connector in accordance with claim 1, wherein the bridge portion is located a height away from the circuit board proximate to the housing side and the terminal body extends to a distal end that clears the height of the bridge portion.

9. The power connector in accordance with claim 1 wherein the power contact includes a spring member that extends from the bridge portion toward the loading side, the spring member configured to be deflected toward the body panels and engage the connector housing to prevent the power contact from being withdrawn from the housing cavity.

10. The power connector in accordance with claim 1 wherein the power contact includes at least one positioning member on the first or second body panels that project in the mounting direction, the positioning member(s) configured to engage the connector housing proximate to the circuit board to facilitate holding the power contact within the connector housing.

11. The power connector in accordance with claim 1 wherein the power contact includes a spring member that extends from the bridge portion and is configured to engage the connector housing and also at least one positioning member on the first or second body panels that project in the mounting direction, the positioning member(s) configured to engage the connector housing proximate to the circuit board, wherein the spring member and the positioning member(s) engage the connector housing, the positioning and spring members cooperating with each other to prevent the power contact from being moved in a direction along the circuit board.

12. The power connector in accordance with claim 1 where each of the first and second body panels includes a plurality of contact beams that project toward the mating side and are configured to engage the electrical connector.

13. The power connector in accordance with claim 1, wherein the power contact is stamped and formed from a single sheet of material.

14. A power connector comprising:

a connector housing having a mating side configured to engage an electrical connector and a loading side that is opposite the mating side and has an access opening, the connector housing also having a mounting side that is configured to interface with a circuit board and a housing side that is opposite the mounting side, the connector housing including a housing cavity; and a power contact held within the housing cavity and configured to engage the electrical connector, the power contact comprising a body panel having board terminals that extend away from the body panel in a mounting direction to engage the circuit board, the body panel also having a contact terminal that is configured to engage a component contact;

wherein the contact terminal extends through the access opening of the loading side, the contact terminal including a base portion that extends beyond the loading side in a direction along the circuit board and also a terminal body that extends from the base portion in a direction that is away from the circuit board, the housing side being located a height away from the circuit board, the terminal body extending to a distal end that clears the height of the housing side, wherein the base portion is differently sized and shaped than the terminal body to resist deformation when the component contact is directly engaged to the distal end with a force that is in the mounting direction.

15. The power connector in accordance with claim 14, wherein the base portion has a width that is measured along an axis that extends parallel to the circuit board and the terminal body has a width measured along the axis, the width of the base portion being greater than a width of the terminal body.

16. The power connector in accordance with claim 14, wherein the power contact includes a positioning member on the body panel that projects in the mounting direction, the positioning member configured to engage the connector housing proximate to the circuit board to facilitate holding the power contact within the connector housing.

17. The power connector in accordance with claim 14, wherein the body panel includes a plurality of contact beams that project toward the mating side and are configured to engage the electrical connector.

18. The power connector in accordance with claim 14, wherein the body panel and the contact terminal are coplanar.

19. The power connector in accordance with claim 14, wherein the mounting and mating sides are oriented perpendicular to each other.

20. The power connector in accordance with claim 14, wherein the access opening is sized and shaped to permit the power contact to be loaded into the housing cavity through the loading side.

* * * * *